United States Patent [19]

Ruhl et al.

[11] 4,205,947

[45] Jun. 3, 1980

[54] METHOD AND APPARATUS FOR THE VENTILATION OF A FUEL SUPPLY PUMP

[75] Inventors: Karl Ruhl, Gerlingen; Ulrich Kemmner, Sachsenheim, both of Fed. Rep. of Germany

[73] Assignee: Robert Bosch GmbH, Stuttgart, Fed. Rep. of Germany

[21] Appl. No.: 916,190

[22] Filed: Jun. 16, 1978

[30] Foreign Application Priority Data

Sep. 6, 1977 [DE] Fed. Rep. of Germany ..... 2740002

[51] Int. Cl.[2] ..... F04B 23/14; F04B 21/00

[52] U.S. Cl. ..... 417/199 A; 417/203; 417/205; 417/251; 417/366; 417/435; 29/156.4 R

[58] Field of Search ..... 417/203, 205, 199 A, 417/366, 423 R, 901, 435, 251; 415/53 T; 29/156.4 R

[56] References Cited

U.S. PATENT DOCUMENTS

| | | | |
|---|---|---|---|
| Re. 29,445 | 10/1977 | Nusser et al. | 417/423 R |
| 2,055,587 | 9/1936 | Pigott | 417/203 |
| 2,153,360 | 4/1939 | Auger et al. | 417/201 |
| 3,836,291 | 9/1974 | Bottcher et al. | 415/53 T |

FOREIGN PATENT DOCUMENTS

| | | | |
|---|---|---|---|
| 2303687 | 12/1974 | Fed. Rep. of Germany | 417/410 |
| 990462 | 4/1965 | United Kingdom | 417/251 |

*Primary Examiner*—Richard E. Gluck
*Attorney, Agent, or Firm*—Edwin E. Greigg

[57] ABSTRACT

A method for the ventilation of fuel supply pumps as well as a new type of fuel supply pump are proposed which, particularly in pumps having two pumping stages coupled in series within the housing, serve to secure the ventilation of the first pumping stage. Preferably the first pumping stage is embodied as a lateral channel pump which has a forward anterior base plate. The ventilation bore is arranged axially at first in the base plate and in association with the lateral channel and is preferably formed during manufacture in one piece with the base plate; a reduction of the overly-large diameter of the ventilation bore is effected by the insertion of a reduction part to achieve the flow cross section required for ventilation. The ventilation to the outside of the lateral channel stage takes place via an external connection nozzle on the pump housing, which is secured thereon either axially or radially and can be embodied in one piece therewith as necessary. The connection of the ventilation bore of the lateral channel having a reduced cross section with the housing connection nozzle can be made by an elastic medially disposed member.

25 Claims, 10 Drawing Figures

METHOD AND APPARATUS FOR THE VENTILATION OF A FUEL SUPPLY PUMP

BACKGROUND OF THE INVENTION

The invention relates to a method and apparatus for the ventilation of fuel supply pumps. Fuel supply pumps are already known in which the fuel pumping system and the electromotor are enclosed in a cup-shaped housing. It has already been proposed to embody the fuel supply pump in two stages, where the first stage is conventionally a lateral channel pump, while the second pump, coupled in series therewith and effecting the desired high final pressure, operates as a roller piston pump. Both fuel pumps, the lateral channel pump and the roller piston pump, are preferably arranged on a side that is oriented toward the collector of the driving electromotor.

Problems arise with respect to the ventilation of the lateral channel in such pumps, in particular in two-stage fuel supply pumps having a forwardly disposed lateral channel pump.

OBJECT AND SUMMARY OF THE INVENTION

The method and apparatus claimed herein has the advantage that the ventilation of the lateral channel of the channel pump comprising the first stage, or in general the ventilation of the first stage of the pump, is possible in a simple and effective manner without great production expense; at the same time the throttle flow cross section required for the ventilation bore can be precisely maintained at the desired dimensions. A further advantage exists in that the axial and/or radial ventilation bores for the lateral channel in the base plate of the lateral channel pump can be formed in one piece with the base plate directly during manufacture and calibrated insertion bodies which have already been preassembled can then be pressed into these bores.

By means of the dependent claims set forth in this application, particularly those which depend from the main method claim as well as those that depend from the main apparatus claim, further advantages of this invention over the prior art will be readily understood. Of particular advantage is the fact that the distance between the ventilation bore of the base plate or between the reduction part inserted therein and the associated opening of the ventilation nozzle which is secured on the housing is bridged by an elastic intermediary member, which besides providing a perfect seal assures that manufacturing tolerances in the positioning of parts in the area from the opening of the ventilation bore to the ventilation nozzle can be absorbed and equalized axially and radially.

In a further advantageous embodiment the diversion out of the ring channel of the gases or vapors which arise during ventilation is effected by means of a bore that is transverse to the stationary axis in the base plate, which is extended in the direction of the induction nozzle and drilled out and serves in this form as a ventilation nozzle. In this way any further sealing againt the outside which may be required is avoided, namely the sealing of the ventilation nozzle in the housing and the tightness between the ventilation nozzle opening and the elastic intermediary member.

The invention will be better understood as well as further objects and advantages thereof become more apparent from the ensuing detailed description of preferred embodiments taken in conjunction with the drawings.

DESCRIPTION OF THE PREFERRED EMBODIMENTS

In order that the individual embodiments according to the invention may be better understood, the basic principle of a fuel supply pump will first be briefly described with the aid of the drawings in terms of structure and mode of operation. Particularly to be described is a two-stage fuel supply pump whose first pumping stage, located directly at the induction connection, which is preferably embodied as a lateral channel pump, is to be ventilated. In starting the pump and during operation, there are always gas or air bubbles in the supplied fuel, partly generated by thermal influence, which must be conducted away from the working area of the pump, so that its effectiveness is not reduced, as well as that failure in function during further treatment of the fuel up to the injection valves does not occur and additionally that the fuel supply performance does not break down.

Figure 1:
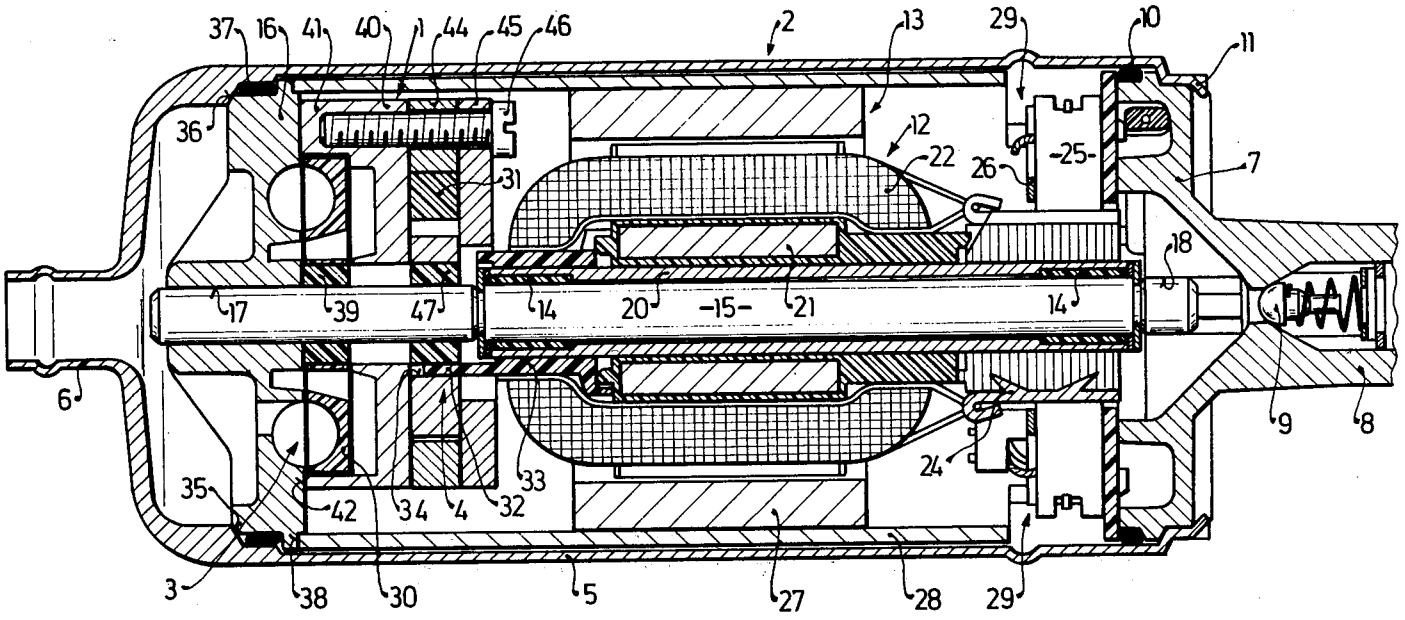
FIG. 1 is a cross-sectional view through a two-stage fuel supply pump.

The fuel supply pump of FIG. 1 comprises a pumping area 1 made up of the two pumping stages 3 and 4 as well as the electromotor 2 which drives both pumps at once. The two pumping stages 3 and 4 are enclosed along with the electromotor in a cup-shaped housing 5, which has an induction connection 6, as shown, and to which a fuel hose, not shown, is to be attached. The cup-shaped housing 5 is closed at one end thereof by means of a cover element 7, on which a pressure connection nozzle 8 and a recoil valve 9 are arranged. Between the housing 5 and the cover element 7 a seal 10 is arranged with the cover element 7 being secured on the open end of the housing 5 by means of a deformed flange means 11.

In the housing interior, as seen from the induction side toward the pressure side, first the two pumps 3 and 4 are arranged, then the electromotor 2; thus the fuel supplied under pressure by the pumps 3 and 4 also flows through the electromotor 2 and its structural elements, in order to cool them.

The electromotor 2 comprises a rotating core or motor armature 12 and a magnetic part 13. The motor armature 12 is fixed on a rigid shaft 15 by means of suitable bearings, for example journal bearings 14—14, the bearing parts in the forward housing area. In the illustrated embodiment, a base plate 16 is located forwardly in the pumping area 1 and will be described in greater detail below. This plate has a central bore 17, into which the shaft 15 is pressed. The other end of the shaft is loosely guided at 18 into a suitable bore of the cover element 7.

The journal bearings 14—14 which support the motor armature 12 on the shaft 15 are arranged in a bearing tube 20, on which a laminated core 21 and a core winding 22 are disposed. Furthermore, there is a commutator bushing 24 affixed to the bearing tube 20 and in this example secured by being pressed against it.

Commutator brushes 25 slide on the commutator bushing 24 and are arranged in cage elements 26. The cage elements 26 are electroconductively connected with connecting terminals, not shown, in the cover element 7. The magnetic part 13 of the electromotor 2 comprises two permanent magnets 27 which are arranged in a tubular or cylindrical holding part 28 and in the example are made of a magnetically conductive material and suitably shaped from sheet metal. This holding part 28 serves also to secure in an appropriate manner at least one stationary structural element in the pumping area 1, since a corresponding tension is exerted on the holding member 28 by the cover element 7 held by the flange means 11 via structural elements shown at 29 but not individually described.

In the embodiment shown in FIG. 1, the clamping and compression pressure of the holding part 28 acts upon the forward base plate 16. The pumping area 1 comprises, as mentioned earlier, two pumping stages 3 and 4 which are separate from each other and are driven simultaneously by the electromotor 2.

In the embodiment shown, the first pumping stage 3 directly oriented to the induction connection 6 comprises a lateral channel pump, while the second pumping stage coupled at the outlet side is embodied as a roller piston pump. The type and structure of the pumps comprising the pumping area can, however, be of any desired kind; each stage is to be viewed in the most general way as a fluid pump, which can be a gear-wheel pump, lateral channel pump, roller piston pump, or any other kind of pump needing ventilation. Between the particular movable parts of each pump, in other words, in the present embodiment between the impeller 30 of the lateral channel pump and the groove disc 31 of the roller piston pump, the motor armature 12 effects a rotary drive of the electromotor by means of a coupler tang 32 of the coupler 33 connected with the electromotor 2, said tang 32 projecting into a corresponding groove 34 of the groove disc 31. The coupler connection between the groove disc 31 and the impeller 30 is not separately illustrated.

Proceeding from the induction connection 6, the pumping area is formed by a base plate 16, which on its side toward the impeller 30 comprises the stationary part of the lateral channel pump 3 which operates in connection with the impeller 30. The particular structure of the pumps comprising pumping stages 3 and 4 and their mode of operation need not be described here, since such fluid pumps (lateral channel pumps, roller piston pumps) are known to those skilled in the art.

The forward base plate 16 contacts by means of oblique or chamfered surfaces 35 with correspondingly embodied opposing surfaces 36 in the interior of the housing; a seal 37 is inserted between neighboring ring surfaces of the interior housing wall and the forward base plate 16. The base plate 16 is held in its stationary position in the housing by the cylindrical holding member 28 already mentioned, which grasps a shoulder 38 of the forward base plate 16, or else by an intermediate base plate 40 if the holder grasps this part. Further, connected to the forward base plate, from left to right in the plane of the drawing, are the other structural elements comprising the pumping stages 3 and 4. First is the impeller 30 of the lateral channel pump, which can be fixed on the stationary shaft 15 by a journal bearing 39. This is then followed by the intermediate base plate 40, which with its peripheral ring flange or extension 41 overlaps the impeller of the lateral channel pump and rests with its flanged front wall 42 on a frontal wall ring flange of the forward base plate 16, or is secured thereto as needed. An intermediate plate 44 and then a support plate 45 are axially arranged next to the intermediate base plate 40 and all of these plates are suitably apertured as shown. The intermediate base plate 40, intermediate plate 44, and support plate 45 can be connected by means of screws 46, of which one is shown in FIG. 1, and can encompass among them the pump rotor or groove disc 31 of the roller piston pump, which is likewise fixed to the rigid shaft 15 by means of a suitable bearing 47.

For the ventilation of the lateral channel of the lateral channel pump, a bore is arranged in the forward flange, that is, in the forward base plate 16 of the lateral channel pump, which has a larger cross-sectional area than the flow cross section or the throttle bore which is desired or required for the degassing or ventilation of the lateral channel. The base plate 16 is embodied preferably as a die-cast part, in which a ventilation bore with the cross-sectional area of the flow cross section can be located only with difficulty. The bore cast in one piece and having a significantly larger cross-sectional area (for comparison purposes, 3 to 4 mm) is thereafter reduced in its effective throttle cross-sectional area by means of a barrier element or insert 50 (see FIG. 2). This reduction part 50, which is pressed into the bore 51 of the base plate 16 and held as required by further means, such as a flanging of the substance making up the base plate, reduces the diameter of the bore 51 at least at one point on its axial extension to a cross-sectional area which corresponds to the flow cross section (for comparison purposes, 1 to 1.5 mm).

Figure 2:
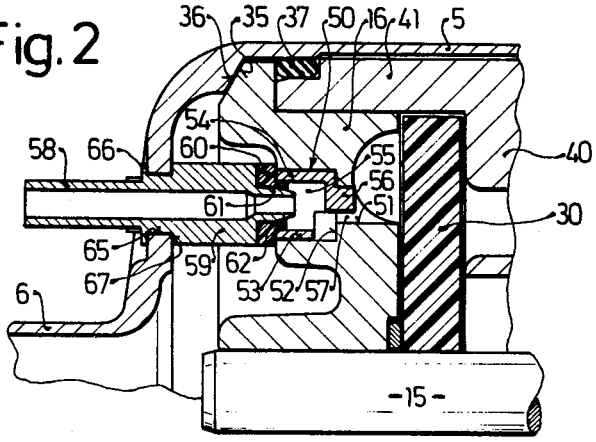
FIG. 2 is a fragmentary view of a first exemplary embodiment of this invention which reveals the ventilation of the lateral channel stage with an external ventilation nozzle on the pump housing.

The reduction part 50 can itself be of the corresponding flow cross section or throttle diameter for the ventilation; however, it can also be embodied as shown in FIG. 2, as an asymmetrical insert, by means of which the remaining free cross section forms a half-moon-shaped opening. In the embodiment of FIG. 2, the bore 51 is reduced at 52 and has a shoulder, so that the bore which has a larger diameter on the induction side becomes a bore part of smaller diameter toward the lateral channel. The reduction part 50 is correspondingly embodied in a complementary way; in the area 53 of the bore 51 which has a larger diameter, the reduction part 50 has a ring-shaped wall 54 with a forward opening; in the area of reduced diameter of the bore 51 of the base plate 16, this is transformed into an area 56 which also has a half-moon-shaped cross section which with the opposing interior cylinder surfaces of the bore 51 forms the hydraulic opening 57. The opening 57 communicates via a connecting area with the interior space 55.

Since, as was mentioned above, the pumping area is preassembled as a whole inside the housing 5, and a perfect seal of the base plate 16 is attained by the arrangement of the opposing surfaces 35 and 36 on the housing under the compression force of the flanging of the cover element, it is necessary to direct the ventilation area 55 toward the outside via a ventilation nozzle 58 which is tightly connected with the housing 5. This requires great radial and axial accuracy, and in accordance with a further characteristic of the present invention, the connection between the end part 59 of the nozzle 58 which projects into the interior of the housing and the opening beside it in the base plate 16 for the reduction part 50 is formed by means of an elastic member 60.

In the exemplary embodiment of the invention shown in FIG. 2, the elastic member is embodied as circular and is seated on a cross-sectional area 61 of the nozzle end 59 which is narrowed, forming a shoulder. The elastic member 60 forms another forwardly narrowed end area 62, with which it projects into the bore of the reduction part 50. In accordance with the embodiment of FIG. 2, the elastic member 60 surrounds the tapered end area 61 of the ventilation nozzle, which projects still further into the hollow space 55 of the reduction part 50.

The elastic member 60 accommodates in an advantageous way the tolerances resulting at this point, which are sometimes very great in a radial and/or axial direction; the requirements for accuracy in manufacture are reduced by simultaneous precise sealing of the ventilation bore in the base plate 16 which leads to the outside and is reduced to the flow cross section.

Figure 3:
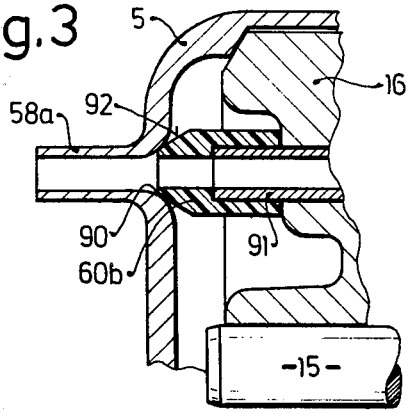
FIG. 3 is another fragmentary cross-sectional view of an exemplary embodiment of the invention with a ventilation nozzle formed in one piece with and arranged on the housing and into which the opening of the tapering tip of a tubular elastic connecting member projects.

The connection of the ventilation nozzle 58 with the front wall of the housing can be effected in many different ways, e.g., it is possible to provide the housing wall directly with a second smaller ventilation nozzle in addition to the induction connection nozzle 6 at the time of manufacture. Since the housing is embodied preferably as an aluminum extrusion-molded part, the ventilation nozzle **58*a*, as shown in FIG. 3, may be formed in one piece with the housing at the same time. It is, however, also possible, as the exemplary embodiment of FIG. 2 shows, to attach a separate ventilation nozzle later during assembly. The ventilation nozzle is guided through a bore 65 of the frontal surface of the housing and secured from the outside by a clamping means 66 which extends 360° around the circumference with the arrangement on the inside of the housing being effected by means of a shoulder 67. For further sealing, a so-called "Loc-tite" sealing means can be provided in the area where the ventilation nozzle 58** enters the frontal surface of the housing.

The elastic member 60 provided between the end area 59 of the ventilation nozzle 58, the area 59 which projects into the interior and includes a shoulder, and the bore in the base plate 16 which is narrowed by the insertion of the reduction part 50 can be made of any convenient substance, for example a plastic with an appropriate degree of hardness or an elastomer, caoutchouc, rubber, or the like. The substance must be resistant to the effect of fuel, that is, to the effect upon it of hydrocarbon bonds in general.

Figure 2A:
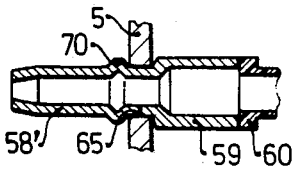
FIGS. 2*a* and 2*b* are detailed cross-sectional views of alternative nozzle structures which embody the ventilation nozzle on the housing and adapt its orientation to the elastic interconnecting member.

FIGS. **2*a* and 2*b* illustrate further possible embodiments for the extension of the ventilation nozzle 58' or 58" through the bore 65 of the frontal wall of the housing 5. In FIG. 2*a* the tubular ventilation nozzle 58' is guided through the frontal wall and then secured by a circular ridge 70** so that there is a firm tension connection. The seal here as well as can be effected again by means of an adhesive substance such as "Loc-tite".

Figure 2B:
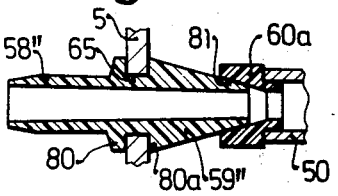

In the embodiment of the invention shown in FIG. **2*b* the ventilation nozzle 58" is preferably made of a molded plastic substance which is formed in the shape of a nozzle and arranged to extend through an aperture in the housing 5. To effect a sealing connection between the plastic nozzle and the bore 65 in the housing, the area through which the bore extends can be painted with an appropriate adhesive or varnish before the plastic nozzle is molded thereon, and then the deformed areas 80 and 80*a* grasp on both sides of the bore in order to support the nozzle securely in the bore. In the embodiment of FIG. 2*b*, it will also be noted that the nozzle end area 59" which extends into the interior of the housing tapers in the fashion of a truncated cone and projects into a complementally cone-shaped opening 81 associated with the nozzle end area 60*a***.

It is further significant that in all embodiments, including those to be described below, the transition surfaces between the elastic member and the reduction part on one side and the associated end of the ventilation nozzle on the other side are tight as a result of a corresponding compression effect resulting from the flanging inward of the covering. Obviously the connection between the elastic member and the ventilation nozzle and/or reduction part can, as desired, be effected by adhesion or by other connection techniques; it is also possible to vulcanize the elastic member onto the nozzle end area. Such a procedure is particularly valuable when the corresponding wall parts of the elastic member and the nozzle end area come into contact with each other in the assembly as in the exemplary embodiment of FIG. **2*a***.

It was noted above that in the embodiment of FIG. 3 that the ventilation nozzle **58*a* which projects outward is a component formed in one piece with the housing, which is embodied as an aluminum extrusion part. Thus, in this embodiment the distance between the reduced ventilation bore of the base plate 16 and the ventilation nozzle 58*a* or the opening in the interior housing wall formed thereby is bridged completely by the elastic member 60*b*. To achieve an improved seating of the flexible member 60*b* it is formed in the manner of a nipple and includes a chamfered front wall 92 that is complemental to the shape of the inner wall denoted 90. As shown the nipple is supported on the short pipe extension 91. Thus it can be readily understood that the conically tapered tip 92 of the elastic member 60***b* is forced under pressure within the opening area or the opening cone of the ventilation nozzle opening. Further, it will be understood that in this embodiment of the invention, particularly large radial and axial tolerances can be absorbed.

Figure 4:
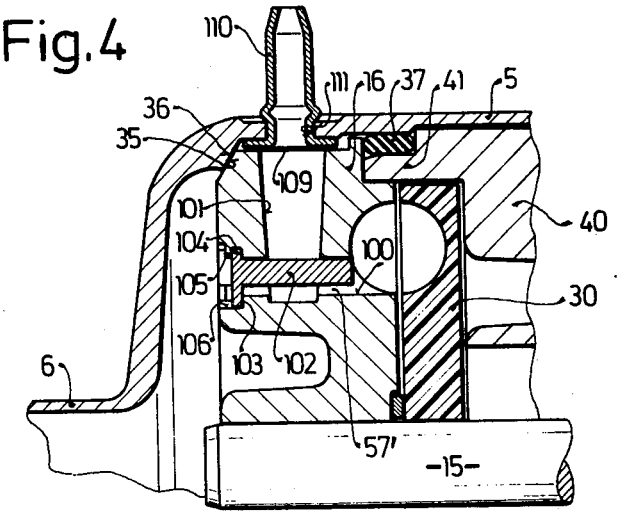
FIG. 4 is another fragmentary cross-sectional view of an exemplary embodiment of the invention with a radial means for conducting gases or vapors away from the area, whereby an axial ventilation bore having a reduction part and a radial bore communicating therewith are arranged in the base plate of the lateral channel pump and the axial ventilation bore opens into a ring channel.
Figure 5:
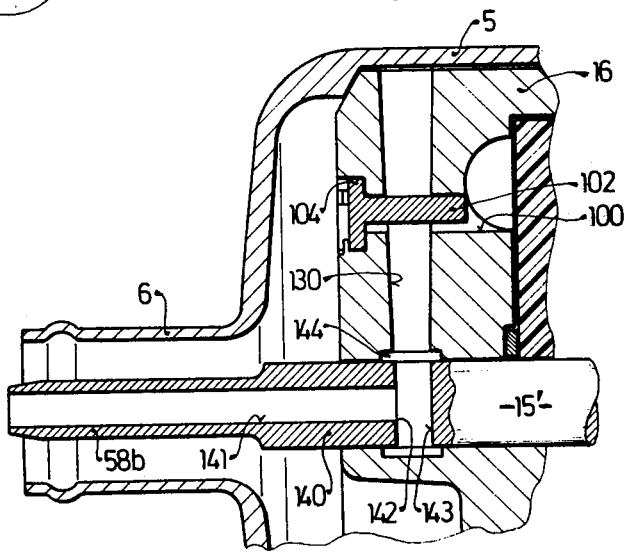
FIG. 5 is another fragmentary cross-sectional view of a structure which is capable of conducting the ventilated gases out of the ring channel or the axial ventilation bore to the stationary axis and from there centrally inside the induction nozzle to which a double-walled hose is attached.

The ventilation systems shown in FIGS. 4 and 5 are different from the above embodiments, for here, the axial ventilation channel in the base plate 16 is rotated by a 90° angle and arranged to extend in a radial direction.

Figure 4A:
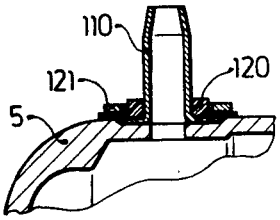
FIG. 4*a* is a detailed cross-sectional view of further possible means for securing a lateral ventilation nozzle on the housing.

In the embodiment of FIG. 4, the base plate 16 has two openings or bores in communication with each other, namely a channel 100 which extends axially from the lateral channel of the lateral channel pump 3 toward the frontal wall on the induction side, and then a radially directed transverse channel 101 branches off therefrom approximately in the center of the base plate 16. Both bores or channels 100, 101 can be formed by molding at the time the base plate 16 is produced, in which case the inclusion of a core insert 102 which forms the reduction part is made easier by the guiding of the axial bore 100 through to the end surface on the induction side of the base plate 16. At this point the bore is widened and a shoulder 103 formed, so that when the core insert which serves as a reduction part to produce the flow cross section is placed in position, its annular flange 104 abuts the shoulder 103. Here, as well, a firm seat can be provided by an inward flanging or upsetting of the material of the base plate 16 to form stop elements 105 from the substance of the extended bore part 106. The effective throttle cross-sectional area is formed as at 57'. The transverse bore 101, which is associated with the axial bore 100, opens into an annular space between the base plate 16 and the housing 5, from which the air or vapor is ventilated by means of a ventilation nozzle 110 that extends outwardly in a radial direction. In this exemplary embodiment, sealing problems with respect to the introduction of the sealing nozzle 110 into the housing wall do not arise, since the circular space 109 is sealed off both on the compression side and the induction side, that is, on the one side by a sealing means 37 and on the other by the surfaces 35, 36 of base plate 16 and housing 5 which are in firm contact with each other. The ventilation nozzle 110 can be introduced into the bore 111 of the lateral wall of the housing in any convenient manner, for example, as is shown in FIG. 4, by holding with a circular torus, or as in FIG. 4a with the aid of a sealing element 120 vulcanized thereon and made of an elastomer, for example rubber, in which case the ventilation nozzle is held by clamping bands or brackets 121 on both sides.

The ventilation nozzle opens in accordance with the object of the invention into the interior of the fuel tank by means of a hose connection attached to it, so that fuel particles (fuel vapor) carried along with it are redirected to the fuel reserve.

In the embodiment of FIG. 5 as well, a radial transverse bore 130 is provided between the axial channel 100 which is provided with the core insert 102 and the ventilation nozzle; however, here this bore solely represents a radial intermediate bore between two axial sections. The ventilation nozzle 58*b* is arranged concentrically within the induction connection nozzle 6 in this embodiment and is formed of a central extension 140, which is set into an aperture in the base plate 16 and preferably embodied in one piece with the stationary shaft 15' pressed into the base plate 16. For this purpose, the extension piece of the axis 140 has a central bore 141, which opens at 142 into a transverse bore 143 of the shaft 15'. The shaft 15' is surrounded at this point by the circular space 144, which opens into the radial transverse bore 130. The transverse bore 130 and the vertical bore 100 extend for the sake of efficiency through the substance of the base plate 16 to the appropriate end wall, so that the reducing core insert 102 can be introduced into the axial bore 100, while the transverse bore 130 is so embodied to make its manufacture much easier. It is further also preferably slightly cone-shaped, so that after manufacture the core parts are more easily removed. A double-walled hose with a coaxial interior hose member is then required to divert the ventilated air, gas, and vapors. On the other hand, the advantage results that only a single hose is necessary for both the carrying of fuel to the induction nozzle 6 and the ventilation of the pump, and only a single nozzle needs to be inspected as to the firmness of its seating.

Figure 7:
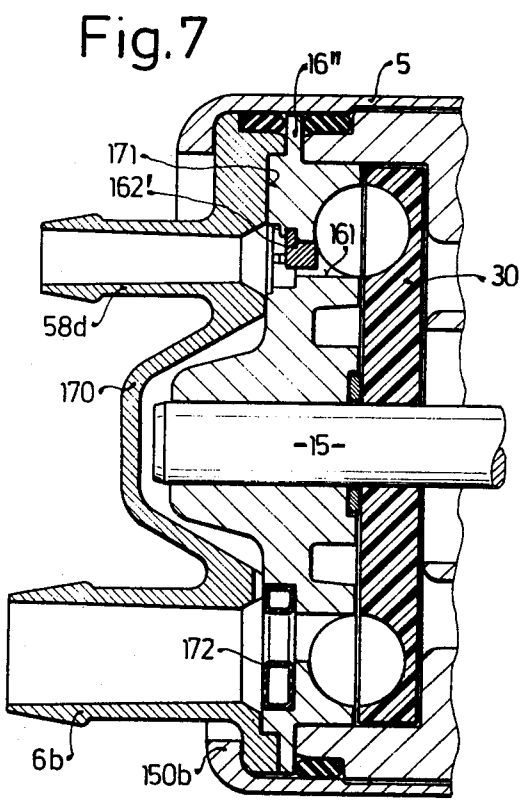
FIG. 7 is a fragmentary cross-sectional view of an embodiment where the housing which is open on both sides has in addition to the base plate a cover part, which is preferably provided in one piece with fuel and ventilation connecting nozzles.
Figure 6:
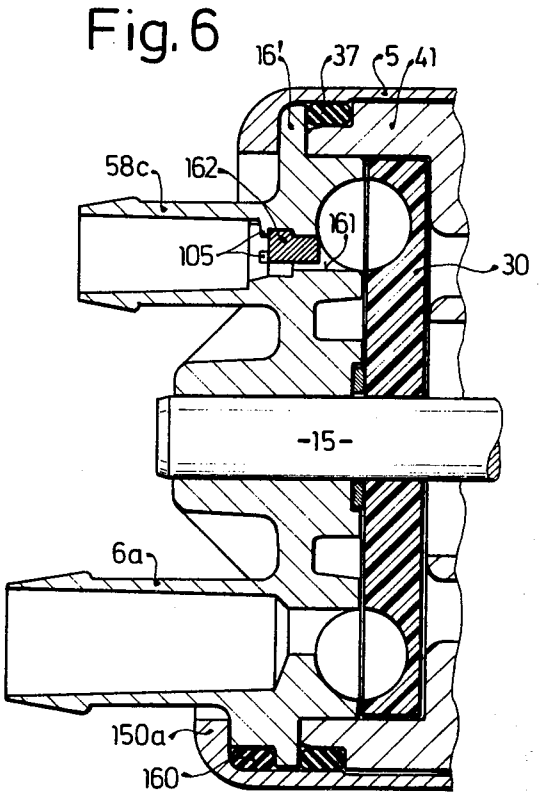
FIG. 6 is a fragmentary cross-sectional view of an embodiment in which the housing of the fuel supply pump is open on both sides and the forward base plate of the lateral channel pump bears induction nozzles and ventilation nozzles.

Two further alternative embodiments may be finally seen in FIGS. 6 and 7; common to both is the fact that the housing is open on its frontal side and has only a single ring flange 150*a* (FIG. 6), 150*b* (FIG. 7) each of which retain the base plate 16' securely in position.

In the embodiment of FIG. 6, the annular flange 150*a* of the housing 5 secures the forward base plate 16' of the lateral channel pump directly and firmly, said base plate 16' bearing the induction nozzle 6*a* and a ventilation nozzle 58*c*. In this way the housing is much more simply constructed; the seal between the housing wall and the base plate is accomplished by the compression seating achieved through the flanging means referred to above. An additional sealing means 160 can also be provided as shown. The base plate 16' comprises an aluminum extrusion-molded part. The tightness of the shaft 15 with respect to the surrounding area is also accomplished by the compression seating between the shaft axis and the forward base plate 16'. In this case as well no elastomeric connecting member is necessary between the axial ventilation bore 161 and the ventilation nozzle 58*c*, since the latter opens in one piece into the former. The reduction part 162 is secured in a suitable manner in the ventilation bore, for example as shown in FIG. 4, by means of an upsetting or deforming action of the material adjacent to the opening so as to form areas 105 where the ventilation bore 161 opens into the ventilation nozzle 58*c*.

Alternatively a separate cover element 170 on the induction side can be employed, as shown in FIG. 7, which cover element is held by the annular flange 150*b* of the housing 5 which is turned radially inward and which complements with its inner shape of the wall the contour of the base plate 16'' in contact with it. Induction nozzle 6*b* and ventilation nozzle 58*d* are formed in one piece with the cover element 170. Since in this case the cover element 170 which faces the housing interior can form a larger circular surface 171 around the interior bore of the ventilation nozzle 58*d*, the sealing of the axial ventilation bore, with its inserted reduction member 162' which is held by flanging means, against the gas over-pressure is accomplished by means of the perfect plane alignment of the circular surface 171 with a corresponding circular surface of the base plate 16'' and by means of a fluid sealing.

Since two cast parts are disposed on each other in the embodiment shown in FIG. 7, namely the cover element 170 and the base plate 16'', the possibility arises of effecting sound insulation by means of the intermediate positioning of a compressible structural element 172. The compressible structural element 172 can be embodied as an air-filled hose, cushion, or the like.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A method for ventilating a fuel supply pump through a hydraulic throttle cross section having a housing in which a two-stage pumping system is disposed together with a driving electromotor, the two stage pumping system including a lateral-channel pump as a first pumping stage and a second, subsequent roller-piston pumping stage, comprising the steps of, forming a ventilation bore having a cross section larger than said hydraulic throttle cross section in a stationary base plate of one of said pumping stages and pressing a reduction part in said bore to reduce the cross section of said bore to such a cross section as corresponds with the desired hydraulic throttle cross section for ventilating said one pumping stage.

2. A method in accordance with claim 1, including the steps of, providing a ventilation nozzle having an end portion extending within said housing and providing a ventilation opening formed by the pressing of said reduction part in said bore, placing an elastic connecting member between said reduction part and said ventilation nozzle end portion for the purpose of compensating for at least one of axial and radial dimensions.

3. A method in accordance with claim 1, wherein said forming step is carried out by directing the path of said ventilation bore in said base plate both axially and radially.

4. A method in accordance with claim 1, wherein said fuel supply pump is provided with an intake connection and including the steps of extending said ventilation bore within the interior of said intake connection and directing said ventilation bore out of the housing of said fuel supply pump.

5. A fuel supply pump comprising a housing, a two-stage pumping system disposed in said housing together with a driving electromotor, said two-stage pumping system comprising a first pumping stage embodied as a lateral channel pump and a second, subsequent roller piston pumping stage, a forward base plate and a hydraulic throttle cross section for ventilating at least said first pumping stage or gases, said hydraulic throttle cross section including an axial ventilation bore in said forward base plate and a reduction part in the form of a core insert disposed in said axial ventilation bore for reducing the diameter of said axial bore to the desired hydraulic throttle cross section.

6. A fuel supply pump in accordance with claim 5, including a separate ventilation nozzle disposed on said pump housing for the further conveyance of the ventilated gases.

7. A fuel supply pump in accordance with claim 6, wherein said ventilation nozzle is integral with said housing.

8. A fuel supply pump in accordance with claim 6, wherein said pump housing is provided with a bore and wherein said ventilation nozzle is provided with integral means for retaining said nozzle in said housing bore.

9. A fuel supply pump in accordance with claim 6, wherein said pump housing is provided with a bore and wherein said ventilation nozzle includes an upset portion forming a circular ridge for retaining said ventilation nozzle in said housing bore.

10. A fuel supply pump in accordance with claim 6, wherein said pump housing is provided with a bore and wherein said ventilation nozzle is plastic having overlapping areas on both sides of the housing portion defining said bore.

11. A fuel supply pump in accordance with claim 10, wherein said ventilation nozzle has an end portion of narrowing conical shape extending into the interior of said housing.

12. A fuel supply pump in accordance with claim 6, wherein said ventilation nozzle includes an end portion of reduced diameter extending into the interior of said housing and including an elastic connecting member disposed between said portion of reduced diameter and said axial bore in said base plate.

13. A fuel supply pump is accordance with claim 12, wherein said reduction part is provided with a bore and wherein said nozzle end portion is of protruding, tapered configuration forming a shoulder and wherein said elastic connecting member is disposed annularly on said nozzle end portion and wherein said elastic connecting member includes an axial ring flange which engages said reduction part inner bore.

14. A fuel supply pump in accordance with claim 11 including an elastic connecting member for connecting said ventilation nozzle to said axial bore, said elastic connecting member having an opening of outwardly tapered, conical configuration for receiving said ventilation nozzle end portion of narrowing conical shape.

15. A fuel supply pump in accordance with claim 12, wherein said ventilation nozzle is integral with said pump housing and protrudes solely exteriorly thereof and wherein said axial ventilation bore is provided with a tubular extension, said elastic connecting member being seated on said tubular extension in bridging engagement with said base plate and said ventilation nozzle.

16. A fuel supply pump in accordance with claim 12, wherein said elastic connecting member and an end area of said ventilation nozzle located in the housing interior contact one another upon impact and are connected together.

17. A fuel supply pump in accordance with claim 12, including a cover element for closing one end of and wherein said elastic connecting member is formed from an elastomeric material such as caoutchouc, rubber or the like and, axially and radially enlarged, said elastic connecting member being configured whereby upon insertion of said pumping system with said electromotor into said housing and the flanging of said one end of said housing in engagement with said cover element, a press seating is obtained which assures the tightness of the elastic connecting member with the adjacent parts.

18. A fuel supply pump in accordance with claim 6, wherein said pump housing is provided with a bore and wherein said ventilation nozzle is secured in said housing bore and is disposed laterally on said housing, a radial annular channel between said base plate and the inner wall of said housing, a radial transverse bore for connecting said axial ventilation bore with said radial annular channel, said ventilation nozzle being directed onto said transverse bore and said annular channel, said core insert for reducing the cross section of the axial ventilation bore to the hydraulic diameter disposed within said ventilation bore from the side of said base plate opposite said electromotor and means for securing said core insert in said ventilation bore including a cutting provided in the substance of said base plate.

19. A fuel supply pump in accordance with claim 18, including a rubber sealing element on said housing and two clamping bands for securing said lateral ventilation nozzle on said housing.

20. A fuel supply pump in accordance with claim 18, wherein said pump is provided with an intake connection and wherein said ventilation nozzle extends within the interior of the intake connection, said transverse bore being directed inward to the center of said base plate in communication with said ventilation nozzle for the purpose of ventilation.

21. A fuel supply pump in accordance with claim 20, including a stationary shaft in said base plate, said shaft being extended outward in the direction of said intake connection and inside the same in order to form said ventilation nozzle, said ventilation nozzle having an interior bore which communicates via an annular space with said transverse bore.

22. A fuel supply pump in accordance with claim 7, wherein said pump is provided with an intake connection and wherein both the ventilation nozzle and the intake connection are integral with said base plate of said lateral channel pump, said housing including an inwardly protruding flange for retaining said base plate in said housing and means integral in said base plate for retaining said core insert in said axial ventilation bore with said axial ventilation bore communicating directly with said ventilation nozzle.

23. A fuel supply pump in accordance with claim 7, wherein said housing includes a separate housing cover element having a ventilation nozzle and an intake connection, an inwardly protruding housing ring flange retaining said housing cap, a flat annular surface on said cap and said base plate with a fluid seal therebetween sealing said ventilation bore and the inner opening of said ventilation nozzle against gas overpressure.

24. A fuel supply pump in accordance with claim 23, including noise-damping means disposed between said cover element and said lateral channel pump base plate.

25. A fuel supply pump in accordance with claim 5, wherein at least one of the axial and radial ventilation bores in said base plate is integral with said base plate with larger cross-sectional dimensions than are required for the said hydraulic throttle cross section.

* * * * *